US008338069B2

(12) United States Patent
Andaya et al.

(10) Patent No.: US 8,338,069 B2
(45) Date of Patent: Dec. 25, 2012

(54) TONER COMPOSITIONS

(75) Inventors: Brian J. Andaya, Ontario, NY (US); Timothy L. Lincoln, Rochester, NY (US); D. Paul Casalmir, Sodus, NY (US); Joseph L. Leonardo, Penfield, NY (US); Anthony Uttaro, Jr., Webster, NY (US)

(73) Assignee: Xerox Corporation, Norwalk, CT (US)

( * ) Notice: Subject to any disclaimer, the term of this patent is extended or adjusted under 35 U.S.C. 154(b) by 232 days.

(21) Appl. No.: 12/838,693

(22) Filed: Jul. 19, 2010

(65) Prior Publication Data

US 2012/0015292 A1 Jan. 19, 2012

(51) Int. Cl.
*G03G 5/00* (2006.01)

(52) U.S. Cl. ..... 430/137.14; 430/137.1

(58) Field of Classification Search ..... 430/137.1, 430/137.14
See application file for complete search history.

(56) References Cited

U.S. PATENT DOCUMENTS

| | | | |
|---|---|---|---|
| 3,590,000 | A | 6/1971 | Palermiti et al. |
| 3,847,604 | A | 11/1974 | Hagenbach et al. |
| 3,944,493 | A | 3/1976 | Jadwin et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,236,629 | A | 8/1993 | Mahabadi et al. |
| 5,330,874 | A | 7/1994 | Mahabadi et al. |
| 5,364,729 | A | 11/1994 | Kmiecik-Lawrynowicz et al. |
| 5,403,693 | A | 4/1995 | Patel et al. |
| 5,959,066 | A | 9/1999 | Charbonneau et al. |
| 6,025,061 | A | 2/2000 | Khanarian et al. |
| 6,063,464 | A | 5/2000 | Charbonneau et al. |
| 6,063,827 | A | 5/2000 | Sacripante et al. |
| 6,107,447 | A | 8/2000 | Kreuder et al. |
| 6,214,507 | B1 | 4/2001 | Sokol et al. |
| 6,359,105 | B1 | 3/2002 | Ianni et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,452,646 | B2 | 11/2008 | Hu et al. |
| 2007/0015075 | A1 | 1/2007 | Vijayendran et al. |
| 2008/0145775 | A1 | 6/2008 | Vijayendran et al. |
| 2009/0081577 | A1 | 3/2009 | Mang et al. |
| 2010/0062359 | A1 | 3/2010 | Bensing et al. |
| 2010/0203439 | A1* | 8/2010 | Zhou et al. ..... 430/108.6 |
| 2010/0316946 | A1* | 12/2010 | Faucher et al. ..... 430/108.23 |

* cited by examiner

*Primary Examiner* — Stewart Fraser
(74) *Attorney, Agent, or Firm* — MDIP LLC

(57) ABSTRACT

The present disclosure provides processes for producing toner particles, and toner particles produced by such processes. The processes of the present disclosure combine melt-mixing and grinding of toner components to produce toner particles, followed by a coalescing treatment which provides toner particles having desirable spherical properties.

19 Claims, No Drawings

TONER COMPOSITIONS

BACKGROUND

The present disclosure relates to toners suitable for electrophotographic apparatuses.

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

One issue that may arise with toners produced by processes including pulverizing is that the resulting particles may not be spherical. Defects, including toner filming and unstable image quality, can occur where non-spherical toners are used.

Improved toners, and methods for forming such toners, thus remain desirable.

SUMMARY

The present disclosure provides toners and processes for producing same. In embodiments, a process of the present disclosure includes melt-mixing an amorphous resin, an optional crystalline resin, an optional wax, and an optional colorant to form a toner; pelletizing the toner to form toner pellets; processing the toner pellets to form toner particles; contacting the toner particles with deionized water and at least one surfactant to form a mixture; coalescing the toner particles by heating the mixture to a temperature of from about 50° C. to about 100° C.; and recovering toner particles from the mixture, wherein the toner particles possess a circularity of from about 0.92 to about 0.999.

In other embodiments, a process of the present disclosure includes melt-mixing an amorphous bio-based polyester resin, a crystalline resin, an optional wax, and an optional colorant to form a toner; pelletizing the toner to form toner pellets; processing the toner pellets to form toner particles; contacting the toner particles with deionized water and at least one surfactant such as nonionic surfactants, anionic surfactants, cationic surfactants, and combinations thereof, to form a mixture; coalescing the toner particles by heating the mixture to a temperature of from about 50° C. to about 100° C., with mixing at a rate of from about 75 revolutions per minute to about 400 revolutions per minute, for a period of time of from about 0.1 hours to about 9 hours; and recovering toner particles from the mixture, wherein the toner particles possess a circularity of from about 0.93 to about 0.995.

In yet other embodiments, a process of the present disclosure includes melt-mixing an amorphous bio-based polyester resin derived at least in part from a material such as natural triglyceride vegetable oils, phenolic plant oils, and combinations thereof, a crystalline resin, an optional wax, and an optional colorant to form a toner; pelletizing the toner to form toner pellets; processing the toner pellets to form toner particles; contacting the toner particles with deionized water and at least one surfactant such as sodium lauryl sulfate, sodium dodecylbenzene sulfonate, sodium dodecylnaphthalene sulfate, dialkyl benzenealkyl sulfates, dialkyl benzenealkyl sulfonates, abitic acid, alkyldiphenyloxide disulfonate, branched sodium dodecyl benzene sulfonates, and combinations thereof, to form a mixture; coalescing the toner particles in the mixture by heating the mixture to a temperature of from about 50° C. to about 100° C., with mixing at a rate of from about 50 revolutions per minute to about 500 revolutions per minute, for a period of time of from about 0.1 hours to about 9 hours, at a pH of from about 6 to about 10; and recovering toner particles from the mixture, wherein the amorphous bio-based polyester resin is present in an amount of from about 1 percent by weight of the toner components to about 95 percent by weight of the toner components, the surfactant is present in an amount from about 0.01% to about 5% by weight of the toner particles, and the toner particles possess a circularity of from about 0.92 to about 0.999.

DETAILED DESCRIPTION

The present disclosure provides processes for producing toners. In embodiments, a process of the present disclosure includes forming toner particles by melt-mixing, extruding, and grinding the components utilized to form toner particles, and then subjecting the ground particles to a coalescing step to obtain particles having the desired sphericity.

Resins

Any suitable resin may be utilized in forming a toner of the present disclosure. Such resins, in turn, may be made of any suitable monomer. Any monomer employed may be selected depending upon the particular polymer to be utilized.

Suitable monomers useful in forming the resin include, but are not limited to, styrenes, acrylates, methacrylates, butadienes, isoprenes, acrylic acids, methacrylic acids, acrylonitriles, diols, diacids, diamines, diesters, diisocyanates, combinations thereof, and the like. Any monomer employed may be selected depending upon the particular polymer to be utilized.

In embodiments, the resin may be a polymer resin including, for example, resins based on styrene acrylates, styrene butadienes, styrene methacrylates, and more specifically, poly(styrene-alkyl acrylate), poly(styrene-1,3-diene), poly-styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In other embodiments, the resins utilized to form toners of the present disclosure may be polyester resins. Such polyester resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, an unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, a suitable polyester resin may be an amorphous polyester such as a poly(propoxylated bisphenol A co-fumarate) resin having the following formula (I):

(I)

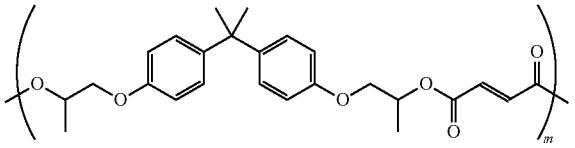

wherein m may be from about 5 to about 1000. Examples of such resins and processes for their production include those disclosed in U.S. Pat. No. 6,063,827, the disclosure of which is hereby incorporated by reference in its entirety.

In some embodiments, the amorphous resin may be crosslinked. An example is described in U.S. Pat. No. 6,359,105, the disclosure of which is hereby incorporated by reference in its entirety. For example, crosslinking may be achieved by combining an amorphous resin with a crosslinker, sometimes referred to herein, in embodiments, as an initiator. Examples of suitable crosslinkers include, but are not limited to, for example, free radical or thermal initiators such as organic peroxides and azo compounds.

In embodiments, an amorphous resin utilized to form a toner of the present disclosure may be at least one bio-based amorphous polyester resin, optionally in combination with another amorphous resin as noted above. As used herein, a bio-based resin is a resin or resin formulation derived from a biological source such as vegetable oil instead of petrochemicals. As renewable polymers with low environmental impact, their principal advantages are that they reduce reliance on finite resources of petrochemicals; they sequester carbon from the atmosphere. A bio-resin includes, in embodiments, for example, a resin wherein at least a portion of the resin is derived from a natural biological material, such as animal, plant, combinations thereof, and the like. In embodiments, at least a portion of the resin may be derived from materials such as natural triglyceride vegetable oils (e.g. rapeseed oil, soybean oil, sunflower oil) or phenolic plant oils such as cashew nut shell liquid (CNSL), combinations thereof, and the like. Suitable bio-based amorphous resins include polyesters, polyamides, polyimides, polyisobutyrates, and polyolefins, combinations thereof, and the like. In some embodiments, the bio-based resins are also biodegradable.

Examples of amorphous bio-based polymeric resins which may be utilized include polyesters derived from monomers including a fatty dimer acid, fatty dimer diacid or fatty dimer diol of soya oil, D-isosorbide, and/or amino acids such as L-tyrosine and glutamic acid as described in U.S. Pat. Nos. 5,959,066, 6,025,061, 6,063,464, and 6,107,447, and U.S. Patent Application Publication Nos. 2008/0145775 and 2007/0015075, the disclosures of each of which are hereby incorporated by reference in their entirety. Combinations of any of the foregoing may be utilized, in embodiments. Suitable amorphous bio-based resins include those commercially available from Advanced Image Resources (AIR), under the trade name BIOREZ™ 13062 and BIOREZ™ 15062. In embodiments, a suitable amorphous bio-based polymeric resin which may be utilized may include a dimer acid of soya oil, isosorbide (which may be obtained from corn starch), with the remainder of the amorphous bio-based polymeric resin being dimethyl terephthalate (DMT). Another suitable bio-based polymeric resin may include about 43.8% by weight D-isosorbide, about 42.7% by weight 1,4-cyclohexane dicarboxylic acid, and about 13.4% by weight of a dimer acid of soya oil.

In embodiments, a suitable amorphous bio-based resin may have a glass transition temperature of from about 45° C. to about 70° C., in embodiments from about 50° C. to about 65° C., a weight average molecular weight (Mw) of from about 2,000 to about 200,000, in embodiments of from about 5,000 to about 100,000, a number average molecular weight (Mn) as measured by gel permeation chromatography (GPC) of from about 1,000 to about 10,000, in embodiments from about 2,000 to about 8,000, a molecular weight distribution (Mw/Mn) of from about 2 to about 20, in embodiments from about 3 to about 15, and a viscosity at about 130° C. of from about 10 Pa*S to about 100000 Pa*S, in embodiments from about 50 Pa*S to about 10000 Pa*S.

The bio-based polymeric resin may have an acid value of from about 7 mg KOH/g to about 50 mg KOH/g, in embodiments from about 9 mg KOH/g to about 48 mg KOH/g, in embodiments about 9.4 mg KOH/g.

Where utilized, the amorphous bio-based resin may be present, for example, in amounts of from about 1 to about 95 percent by weight of the components used to form the toner particles, in embodiments from about 5 to about 50 percent by weight of the components used to form the toner particles.

In embodiments, the amorphous bio-based polyester resin may have a particle size of from about 50 nm to about 250 nm in diameter, in embodiments from about 75 nm to 225 nm in diameter.

In embodiments, suitable latex resin particles may include one or more amorphous bio-based resins, such as a BIOREZ™ resin described above, optionally in combination with one or more of the amorphous resins described above, optionally in combination with a crystalline resin as described below.

As noted above, the amorphous resin may be combined with a crystalline resin. The crystalline resin may be, for example, a polyester, a polyamide, a polyimide, a polyolefin such as a polyethylene, a polypropylene, a polybutylene or an ethylene-propylene copolymer, a polyisobutyrate, an ethylene-vinyl acetate copolymer, combinations thereof, and the like. In embodiments, the crystalline resin may be sulfonated.

The crystalline resin may be prepared by a polycondensation process of reacting an organic diol and an organic diacid in the presence of a polycondensation catalyst.

Examples of organic diols include aliphatic diols with from about 2 to about 8 carbon atoms, such as 1,2-ethanediol, 1,3-propanediol, 1,4-butanediol, 1,5-pentanediol, 1,6-hexanediol, 1,7-heptanediol, 1,8-octanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be present in an amount of from about 45 to about 50 mole percent of the resin, in embodiments from about 47 to about 49 mole percent of the resin, and the alkali sulfo-aliphatic diol can be present in an amount of from about 1 to about 10 mole percent of the resin, in embodiments from about 2 to about 8 mole percent of the resin.

Examples of organic diacids or diesters suitable for the preparation of the crystalline resins include oxalic acid, succinic acid, glutaric acid, adipic acid, suberic acid, azelaic acid, phthalic acid, isophthalic acid, terephthalic acid, cyclohexane dicarboxylic acid, malonic acid and mesaconic acid; diesters or anhydrides thereof; and alkali sulfo-organic diacids such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or combinations thereof. The organic diacid may be present in an amount of, for example, from about 40 to about 50 mole percent of the resin, in embodiments from about 42 to about 48 mole percent of the resin, and the alkali sulfo-aliphatic diacid can be present in an amount of from about 1 to about 10 mole percent of the resin, in embodiments from about 2 to about 8 mole percent of the resin.

In embodiments, the crystalline polyester material may be derived from a monomer system including an alcohol such as 1,4-butanediol, 1,6-hexanediol, and combinations thereof, with a dicarboxylic acid such as fumaric acid, succinic acid, oxalic acid, adipic acid, and combinations thereof. For example, in embodiments the crystalline polyester may be derived from 1,4-butanediol, adipic acid, and fumaric acid.

In embodiments, a stoichiometric equimolar ratio of organic diol and organic diacid may be utilized. However, in some instances, wherein the boiling point of the organic diol is from about 180° C. to about 230° C., an excess amount of diol can be utilized and removed during the polycondensation process.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof. Catalysts may be utilized in amounts of, for example, from about 0.01 mole percent to about 5 mole percent based on the starting diacid or diester used to generate the polyester resin, in embodiments from about 0.5 to about 4 mole percent of the resin based on the starting diacid or diester used to generate the polyester resin.

The amount of catalyst utilized may vary, and can be selected in an amount, for example, of from about 0.01 to about 1 mole percent of the resin. Additionally, in place of an organic diacid, an organic diester can also be selected, with an alcohol byproduct generated during the process.

Suitable crystalline resins include, in embodiments, poly (ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

In embodiments, the crystalline resin may be a short chain length polyester, based upon monomers having a carbon chain of less than about 8 carbons, in embodiments from about 2 carbons to about 8 carbons, in embodiments from about 4 carbons to about 6 carbons. Such resins include, for example, CPES-A3C, a proprietary blend of 1,4-butanediol, fumaric acid, and adipic acid, commercially available from Kao Corporation (Japan).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 70° C. to about 150° C., in embodiments from about 80° C. to about 140° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 1 to about 6, in embodiments from about 2 to about 4.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 4% (first resin)/96% (second resin) to about 96% (first resin)/4% (second resin). Where the resin includes an amorphous resin, a crystalline resin, and a bio-based amorphous resin, the weight ratio of the three resins may be from about 97% (amorphous resin): 2% (crystalline resin): 1% (bio-based amorphous resin), to about 92% (amorphous resin): 4% (crystalline resin): 4% (bio-based amorphous resin).

In embodiments, the resin may be formed by condensation polymerization methods. In other embodiments, the resin may be formed by emulsion polymerization methods.

Toner

The resin described above may be utilized to form toner compositions. Such toner compositions may include optional colorants, waxes, and other additives.

Colorants

As the colorant to be added, various known suitable colorants, such as dyes, pigments, mixtures of dyes, mixtures of pigments, mixtures of dyes and pigments, and the like, may be included in the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 200 to about 20,000, in embodiments from about 400 to about 5,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. In embodiments, toners of the present disclosure may be formed by melt mixing utilizing methods and apparatus within the purview of those skilled in the art. For example, melt mixing of the toner ingredients can be accomplished by physically mixing or blending the particles of the above components and then melt mixing, for example, in an extruder or a Banbury/two roll mill apparatus. Suitable temperatures may be applied to the extruder or similar apparatus, for example from about 65° C. to about 200° C., in embodiments from about 80° C. to about 120° C.

The components of the toner, including the resin(s), wax, if any, colorant, and other additives, may be combined so that the toner extrudate has the desired composition of colorants and additives. The toner extrudate may then, in embodiments, be divided into a pellet or rough crushed form, sometimes referred to herein as "pelletizing," utilizing methods within the purview of those skilled in the art, for example, by pelletizers, fitzmilling, pinmilling, grinders, classifiers, additive blenders, screeners, combinations thereof, and the like. As used herein, "pelletizing" may include any process within the purview of those skilled in the art which may be utilized to form the toner extrudate into pellets, a rough crushed form, or coarse particles, and "pellets" include toner extrudate divided into pellet form, rough crushed form, coarse particles, or any other similar form.

The binder resin may be present in the resulting toner in an amount from about 50 weight percent to about 99 weight percent of the toner composition, in embodiments from about 70 weight percent to about 97 weight percent of the toner composition, with the colorant being present in an amount from about 1 to about 50 weight percent of the toner composition, in embodiments from about 3 to about 20 weight percent of the toner composition.

The toner pellets may then be subjected to grinding utilizing, for example, an Alpine AFG fluid bed grinder, or Sturtevant micronizer, for the purpose of achieving toner particles with a volume median diameter of less than about 25 microns, in embodiments from about 5 microns to about 15 microns, in other embodiments from about 5.5 microns to about 12 microns, which diameters can be determined by a Multisizer II from Beckman Coulter. Subsequently, the toner compositions can be classified utilizing, for example, a Donaldson Model B classifier for the purpose of removing toner fines, that is, toner particles less than about 5 microns volume median diameter.

Optional treatments to increase the Tg of the toner may be utilized including, for example, annealing, slow cooling, combinations thereof, and the like. Such treatments may be utilized after formation of pellets, but prior to grinding.

For example, in embodiments the toner may be subjected to an annealing step. An example is described in U.S. Patent Application Publication No. 2009/0081577, the disclosure of which is hereby incorporated by reference in its entirety.

This annealing step may occur by continuously processing the toner by introducing toner pellets produced after melt-mixing into a heating device, in embodiments a rotary kiln, fluidized bed dryer, combinations thereof, and the like, where the toner is heated to a temperature above its Tg. Suitable devices for annealing the toners may be readily constructed or obtained from commercial sources including, for example, rotary kilns from Harper Corporation. In embodiments, a rotary kiln from Harper Corporation which may be utilized may have a diameter of about 5 inches, a length of about 6 feet, and can operate at from about 1 revolutions per minute (rpm) to about 15 rpm, with a maximum kiln angle of about 30 degrees.

In embodiments, heating the toner to a temperature above its Tg, sometimes referred to herein, in embodiments, as annealing, may allow the polymer system of the binder resin to relax, thereby permitting the crystalline domains of the crystalline polyester component of the binder to recrystallize. This recrystallization will increase the Tg of the toner, thereby avoiding the storage and usage problems which may otherwise occur with a toner having a low Tg.

In embodiments, a suitable temperature for annealing may be from about 50° C. to about 90° C., in embodiments from about 60° C. to about 80° C. In embodiments, annealing the toner may occur for a period of time from about 2 minutes to about 60 minutes, in embodiments from about 15 minutes to about 45 minutes. After annealing, the toner may experience an increase in Tg due to decreased plasticization.

A suitable system for carrying out the annealing described herein may utilize the above systems and any other components within the purview of those skilled in the art. In embodiments, a suitable system for forming and annealing toner may include a melt-mixing device to form an extruded toner; a pelletizer, pinmill, fitzmill, or other device to form the extruded toner into pellets, rough crushed form, coarse particles, or the like; and an optional annealing device such as rotary kilns, fluidized bed dryers, and combinations thereof to form the desired toner particles.

Coalescence

In accordance with the present disclosure, after the toner particles have been subjected to grinding, they are then subjected to a coalescing step to obtain particles with the desired sphericity. Coalescence may be achieved by, for example, combining the toner particles with deionized water, at least one surfactant, combinations thereof, and the like.

Where utilized, the amount of deionized water may be from about 400% to about 800% by weight of the toner particles, in embodiments from about 500% to about 700% by weight of the toner particles.

One, two, or more surfactants may be utilized. Suitable surfactants include, for example, ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner particles, for example from about 0.75% to about 4% by weight of the toner particles, in embodiments from about 1% to about 3% by weight of the toner particles.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium lauryl sulfate (SLS) (also known as sodium dodecylsulfate (SDS)), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

For coalescing, the toner particles, deionized water, and surfactant(s) may be place in any suitable reactor, including a mixing vessel. Any mixing vessel within the purview of those skilled in the art may be utilized. In embodiments, a mixer described above suitable for melt mixing may be utilized.

The toner particles, deionized water, and surfactant(s) may be subjected to mixing at a rate of from about 50 revolutions per minute (rpm) to about 500 rpm, in embodiments from about 75 rpm to about 400 rpm.

Coalescence may proceed while heating the mixture, including toner particles, water and surfactant(s), to a temperature of from about 50° C. to about 100° C., in embodiments from about 55° C. to about 85° C., in embodiments from about 60° C. to about 76° C. Higher or lower temperatures may be used, it being understood that the temperature is a function of the resins used for the binder.

Coalescence may proceed and be accomplished over a period of from about 0.1 hours to about 9 hours, in embodiments from about 0.25 hours to about 4 hours, in embodiments from about 0.5 hours to about 1.5 hours.

During this coalescing step, the pH of the mixture may be maintained utilizing a base to a value of from about 6 to about 10, in embodiments from about 6.2 to about 8, in embodiments at about 7.8. The base utilized to maintain the pH at a desired level may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Utilizing the methods of the present disclosure, the resulting toner particles may possess a circularity of from about 0.92 to about 0.999, in embodiments from about 0.93 to about 0.995, in embodiments from about 0.938 to about 0.988. Circularity may be determined with a Sysmex FPIA-3000 Particle Characterization System from Malvern Instruments Ltd. (Worcestershire, UK). When the resulting spherical toner particles have such a circularity, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

In addition, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 6,214,507, and 7,452,646 the disclosures of each of which are hereby incorporated by reference in their entirety.

The resulting particles can possess the following characteristics:

1) an average volume particle diameter of from about 5 microns to about 15 microns, in embodiments from about 5.5 microns to about 12 microns;
2) Number Average Geometric Size Distribution (GSDn) and/or Volume Average Geometric Size Distribution (GSDv) of from about 1.0 to about 1.7, in embodiments from about 1.1 to about 1.6;
3) a glass transition temperature of from about 30° C. to about 65° C., in embodiments from about 35° C. to about 51° C.

The characteristics of the toner particles may be determined by any suitable technique and apparatus. Volume average particle diameter ($D_{50v}$), GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Developers

The toner particles thus obtained may be formulated into a developer composition. In embodiments, the toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 100° C. to about 200° C., in embodiments from about 110° C. to about 180° C., in other embodiments from about 120° C. to about 170° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be affected by heating the fused image to a temperature at which the toner resin will be crosslinked, for example in a post-fusing operation. In embodiments, crosslinking may be effected at temperatures of from about 200° C. or less, in embodiments from about 100° C. to about 190° C., in other embodiments from about 120° C. to about 180° C.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

A black toner was produced as follows. About 9400 grams of a bio-based polyester resin containing 60% bio-derived content from corn and soy products, commercially available as BIOREZ™ resin from Advanced Image Resources (AIR), was combined with about 400 grams of Mitsubishi Carbon Black #25, and about 200 grams of FMR-0150F embrittling agent, commercially available from Mitsui Chemical Co., Ltd. in a Werner & Pfleiderer ZSK-25 extruder and heated to a temperature of about 95° C. for a period of time of about 60 seconds with mixing at a rate of about 440 RPM. The materials were melt mixed in the extruder and cooled using an MWG pelletizer, commercially available from Werner & Pfleiderer.

The toner was extruded, ground using an Alpine AFG fluid bed grinder, and classified to a particle size of about 8.4 microns using an Acucut classifier.

The resulting toner possessed about 94% by weight of the bio-based resin, about 4% of the Mitsubishi Carbon Black #25, and about 2% of the FMR-0150F embrittling agent.

About 304.39 grams of the above bio-based toner was then combined with about 1638.00 grams deionized water and about 7.61 grams sodium lauryl sulfate (SLS) (surfactant) in a 2 liter glass reactor fitted with four baffles and two P-4 impellers. A temperature ramp-up and coalescence process was run using sodium hydroxide (NaOH) solution to maintain the pH of the mixture at about 7.8 until spherical particles were observed using a Sysmex FPIA 3000. Briefly, the procedure was as follows.

Temperature and pH probes were inserted into the reactor. The reactor mixer (impellers) were started at about 200 revolutions per minute (rpm), so that the impellers pushed the contents of the reactor down, i.e., towards the bottom of the reactor. Two initial samples were taken to determine baseline circularity (using a Sysmex FPIA 3000) and particle size (using a Layson Cell particle analyzer). Heat was applied to the reactor with the temperature increased from about 25° C. to about 65° C. over a period of about 30 minutes; the ramp up rate, i.e., the rate of increase of temperature, was thus about 1.3° C./minute. The pH was maintained at about 7.8 with a 4% NaOH solution.

After about 30 minutes, using a small 20 μm screen, 2 samples were taken, one to determine circularity, and one to determine particle size. When the batch temperature reached about 60° C., this was set as Coalescence T=0.2 samples were again taken, one for circularity, and one for particle size. After Coalescence T=0, the reactor jacket temperature was increased to about 70° C. Samples were then taken at 30 minutes (30') and 60 minutes (60'). After 30 minutes the reactor jacket temperature was increased to 80° C.

Again, the pH was maintained during this time at about 7.8 with a 4% NaOH solution. Particle size and circularity were monitored until the desired circularity was obtained.

Tables 1-4 below set forth the data obtained for the toner produced above. Tables 1-2 set forth the process data, Table 3 has the diameter and circularity of the particles before coalescence, and Table 4 has the diameter and circularity of the particles after coalescence (at 60 minutes, i.e., T=60).

TABLE 1

| Sample Name | Mixer [rpm] | Batch Temp [° C.] | $D_{50\,V}$ (nm) | $D50/16_V$ | $D84/50_V$ | $D_{50\,N}$ (nm) |
|---|---|---|---|---|---|---|
| Baseline Sample | 200 | 26 | 8.43 | 1.368 | 1.288 | 6.34 |
| Ramp Up 30 min | 200 | 50 | 8.93 | 1.366 | 1.278 | 6.72 |
| 0' Coalescence | 200 | 60 | 10.27 | 1.412 | 1.299 | 5.26 |
| 30' Coalescence | 200 | 68 | 10.32 | 1.496 | 1.304 | 1.93 |
| 60' Coalescence | 200 | 76 | 12.03 | 1.610 | 1.266 | 1.79 |

$D_{50\,V}$ = volume average diameter
$D50/16_V$ = ratio of D50 and D16 by volume
$D84/50_V$ = Volume Average Geometric Size Distribution (GSDv)
$D_{50\,N}$ = number average diameter

TABLE 2

| Sample Name | $D50/16_N$ | $D84/50_N$ | % V12.7-39.24 | % N1.26-4.00 | Circularity | pH | Base Added (g) |
|---|---|---|---|---|---|---|---|
| Baseline Sample | 1.341 | 1.376 | 3.77 | 5.88 | 0.938 | 6.85 | 0.00 |
| Ramp Up 30 min | 1.244 | 1.379 | 6.45 | 4.65 | 0.943 | 7.70 | 9.62 |
| 0' Coalescence | 3.139 | 1.748 | 21.46 | 43.99 | 0.975 | 7.80 | 13.70 |
| 30' Coalescence | 1.348 | 2.822 | 22.63 | 80.65 | 0.988 | 7.80 | 6.13 |
| 60' Coalescence | 1.277 | 1.447 | 42.17 | 91.29 | 0.979 | 7.70 | 5.93 |

$D50/16_N$ = Number Average Geometric Size Distribution (GSDn)
$D84/50_N$ = ratio of D84 and D50 by number
% V12.7-39.24 = volume percent between 12.7 and 39.24 microns (represents coarse particles)
% N1.26-4.00 = number percent between 1.26 and 4 microns (represents fine particles)

TABLE 3

| Selection(Diam/Shape) | | | Result | | | | | |
|---|---|---|---|---|---|---|---|---|
| | | | CE Diameter(N) | | Circularity | | | |
| Diameter | | | | | | | | |
| 0.500 <= | CE Diameter(N) | <200.0 | Mean: | 8.117 | Mean: | 0.938 | Density: | 5065 |
| | | | SD: | 2.609 | SD: | 0.033 | Large (%): | 0.00 |
| Shape | | | | | | | | |
| 0.200 <= | Circularity | <=1.000 | CV: | 32.14 | CV: | 3.50 | Middle (%): | 100.00 |
| | | | Mode: | 7.179 | Mode: | 0.955 | Small(%): | 0.00 |
| | | | Lower %: | 5.868 | Lower %: | 0.900 | Selected (%): | 100.00 |
| | | | 50%: | 7.860 | 50% | 0.944 | Analyzed(#): | 2069 |
| | | | Upper %: | 10.775 | Upper %: | 0.971 | Selected (#): | 2052 |

CE Diameter (N) = diameter of a circle in microns with the same area as the particle, weighted by number
CV = (SD/Mean) * 100 = (standard deviation of particle size distribution/average particle diameter) * 100
Mode = particle diameter that occurs with the greatest frequency
Lower % = lower percentile value of the particle size distribution
50% = median percentile value of the particle size distribution
Upper % = upper percentile value of the particle size distribution

TABLE 4

| Selection(Diam/Shape) | | | Result | | | | | |
|---|---|---|---|---|---|---|---|---|
| | | | CE Diameter (V) | | Circularity | | | |
| Diameter | | | | | | | | |
| 0.500 <= | CE Diameter(V) | <200.0 | Mean: | 12.673 | Mean: | 0.979 | Density: | 7885 |
| | | | SD: | 3.393 | SD: | 0.058 | Large (%): | 0.00 |
| Shape | | | | | | | | |
| 0.200 <= | Circularity | <=1.000 | CV: | 26.78 | CV: | 5.97 | Middle (%): | 100.00 |
| | | | Mode: | 12.528 | Mode: | 0.995 | Small(%): | 0.00 |
| | | | Lower %: | 8.025 | Lower %: | 0.962 | Selected (%): | 100.00 |
| | | | 50%: | 12.781 | 50% | 0.996 | Analyzed(#): | 3438 |
| | | | Upper %: | 16.962 | Upper %: | 1.000 | Selected (#): | 3199 |

CE Diameter (V) = diameter of a circle in microns with the same area as the particle, weighted by volume Light microscope pictures were also obtained of the particles both before and after coalescence using a Sony video camera attached to a light microscope, commercially available from Olympus (20× magnification lens). The images demonstrated that the process of the present disclosure produced toner particles that were much more spherical after undergoing the coalescence treatment described herein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

melt-mixing an amorphous resin, an optional crystalline resin, an optional wax, and an optional colorant to form a toner;

pelletizing the toner to form toner pellets; optionally annealing said toner pellets; grinding the toner pellets to form toner particles;

contacting the toner particles with deionized water and at least one surfactant to form a mixture;

coalescing the toner particles by heating the mixture to a temperature of from about 50° C. to about 100° C.; and recovering toner particles from the mixture, wherein the recovered toner particles possess a circularity of from about 0.92 to about 0.999.

2. The process of claim 1, wherein the amorphous resin comprises an amorphous bio-based polyester resin derived at least in part from a material selected from the group consisting of natural triglyceride vegetable oils, phenolic plant oils, and combinations thereof present in an amount of from about 1 percent by weight of the toner particles to about 95 percent by weight of the toner particles.

3. The process of claim 1, wherein the amorphous resin comprises an amorphous bin-based polyester resin derived from a fatty dimer acid, a fatty dimer diol, a fatty dimer diacid, D-isosorbide, L-tyrosine, glutamic acid, and combinations thereof.

4. The process of claim 1, wherein the amorphous resin further comprises at least one amorphous polyester resin selected from the group consisting of poly(propoxylated bisphenol co-fumarate), poly(ethoxylated bisphenolco-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), polty(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

5. The process of claim 1,. wherein the toner particles further comprise a crystalline polyester resin selected from the group consisting of poly(ethylene-adipate), poly(propylene-adipate), poly(butylene-adipate), poly(pentylene-adipate), poly(hexylene-adipate), poly(octylene-adipate), poly (ethylene-succinate), poly(propylene-succinate), poly (butylene-succinate), poly(pentylene-succinate), poly (hexylene-succinate), poly(octylene-succinate), poly (ethylene-sebacate), poly(propylene-sebacate), poly (butylene-sebacate), poly(pentylene-sebacate), poly (hexylene-sebacate), poly(octylene-sebacate), poly (decylene-sebacate), poly(decylene-decanoate), poly-(ethylene-decanoate), poly-(ethylene-dodecanoate), poly (nonylene-sebacate), poly (nonylene-decanoate), copoly (ethylene-fumarate)-copoly (ethylene-sebacate), copoly (ethylene-fumarate)-copoly(ethylene-decanoate), copoly (ethylene-fumarate)-copoly(ethylene-dodecanoate), and combinations thereof.

6. The process of claim 1, wherein the surfactant is selected from the group consisting of nonionic surfactants, anionic surfactants, cationic surfactants, and combinations thereof, present in an amount from about 0.01% to about 5% by weight of the toner particles.

7. The process of claim 1, wherein the surfactant is selected from the group consisting of sodium lauryl sulfate, sodium dodecylbenzene sulfonate, sodium dodecylnaphthalene sulfate, dialkyl benzenealkyl sulfates, dialkyl benzenealkyl sulfonates, abitic acid, alkyldiphenyloxide disulfonate, branched sodium dodecyl benzene sulfonates, and combinations thereof.

8. The process of claim 1, wherein coalescing the toner particles further comprises mixing the mixture at a rate of from about 50 revolutions per minute to about 500 revolutions per minute.

9. The process of claim 1, wherein coalescing the toner particles occurs for a period of time of from about 0.1 hours to about 9 hours.

10. The process of claim 1, wherein coalescing the toner particles occurs at a pH of from about 6 to about 10.

11. A process comprising:

melt-mixing an amorphous bio-based polyester resin, a crystalline resin, an optional wax, and an optional colorant to form a toner;

pelletizing the toner to form toner pellets; optionally annealing said toner pellets; grinding the toner pellets to form toner particles;

contacting the toner particles with deionized water and at least one surfactant selected from the group consisting of nonionic surfactants, anionic surfactants, cationic surfactants, and combinations thereof, to form a mixture;

coalescing the toner particles by heating the mixture to a temperature of from about 50° C. to about 100° C., with mixing at a rate of from about 75 revolutions per minute to about 400 revolutions per minute, for a period of time of from about 0.1 hours to about 9 hours; and recovering toner particles from the mixture, wherein the recovered toner particles possess a circularity of from about 0.93 to about 0.995.

12. The process of claim 11, wherein the amorphous bio-based polyester resin is derived at least in part from a material selected from the group consisting of natural triglyceride vegetable oils, phenolic plant oils, and combinations thereof, present in an amount of from about 5 percent by weight of the toner particles to about 50 percent by weight of the toner particles.

13. The process of claim 11, wherein the amorphous bio-based polyester resin derived from a fatty dimer acid, a fatty dimer diol, a fatty dimer diacid, D-isosorbide, L-tyrosine, glutamic acid, and combinations thereof.

14. The process of claim 11, wherein the toner particles further comprise at least one amorphous polyester resin selected from the group consisting of poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly (butyloxylated bisphenol co-itaconate), poly(co-propoxylated bisphenol co-ethoxylated bisphenol co-itaconate), poly (1,2-propylene itaconate), and combinations thereof.

15. The process of claim 11, wherein the crystalline resin comprises a crystalline polyester resin selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly (pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly (ethylene-sebacate), copoly(ethylene-fumarate)-copo(ethylene-decanoate), copoly(ethylene-fumarate)-copoly(ethylene-dodecanoate), and combinations thereof.

16. The process of claim 11, wherein the surfactant is selected from the group consisting of sodium lauryl sulfate, sodium dodecylbenzene sulfonate, sodium dodecylnaphthalene sulfate, dialky benzenealkyl sulfates, dialkyl benzenealkyl sulfonates, abitic acid, alkyldiphenyloxide disulfonate, branched sodium dodecyl benzene sulfonates, combinations thereof, present in an amount from about 0.75% to about 4% by weight of the toner particles.

17. The process of claim 11, wherein coalescing the toner particles occurs at a pH of from about 6.2 to about 8.

18. A process comprising:

melt-mixing an amorphous bio-based polyester resin derived at least in part from a material selected from the group consisting of a fatty dimer acid, a fatty dimer diol, a fatty dimer diacid, D-isosorbide, L-tyrosine, glutamic acid, natural triglyceride vegetable oils, phenol plant oils, and combinations thereof, a crystalline resin, an optional wax, and an optional colorant to form a toner;

pelletizing the toner to form toner pellets; optionally annealing said toner pellets; grinding the toner pellets to form toner particles;

contacting the toner particles with deionized water and at least one surfactant selected from the group consisting of sodium lauryl sulfate, sodium dodecylhenzene sultanate, sodium dodecylnaphthalene sulfate, dialkyl benzenealkyl sulfates, dialkyl benzenealkyl sulfonates, abitic acid, alkyldiphenyloxide disulfonate, branched sodium dodecyl benzene sulfonates, and combinations thereof, to form a mixture;

coalescing the toner particles in the mixture by heating the mixture to a temperature of from about 50° C. to about 100° C., with mixing at a rate of from about 50 revolutions per minute to about 500 revolutions per minute, for a period of time of from about 0.1 hours to about 9 hours, at a pH of from about 6 to about 10; and recovering toner particles from the mixture, wherein the amorphous bio-based polyester resin is present in an amount of from about 1 percent by weight of the toner components to about 95 percent by weight of the toner components, the surfactant is present in an amount from about 0.01% to about 5% by weight of the toner particles, and the recovered toner particles possess a circularity of from about 0.92 to about 0.999.

19. The process of claim 18, wherein the toner particles further comprise at least one amorphous polyester resin selected from the group consisting of poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly (butyloxylated bisphenol co-itaconate), poly(co-propoxylated bisphenol co-ethoxylated bisphenol co-itaconate), poly (1,2-propylene itaconate), and combinations thereof.

* * * * *